US005883273A

United States Patent [19]

Miller et al.

[11] Patent Number: 5,883,273

[45] Date of Patent: Mar. 16, 1999

[54] POLYUNSATURATED FATTY ACIDS AND FATTY ACID ESTERS FREE OF STEROLS AND PHOSPHORUS COMPOUNDS

[75] Inventors: Robert Alan Miller, Columbus; Terrence Bruce Mazer, Reynoldsburg, both of Ohio; Charles Allan McCombs, Kingsport, Tenn.

[73] Assignee: Abbott Laboratories, Abbott Park, Ill.

[21] Appl. No.: 592,831

[22] Filed: Jan. 26, 1996

[51] Int. Cl.[6] ..... C11C 1/00

[52] U.S. Cl. ..... 554/169; 554/167

[58] Field of Search ..... 554/167, 169

[56] References Cited

U.S. PATENT DOCUMENTS

| | | | |
|---|---|---|---|
| 4,104,286 | 8/1978 | Fallis et al. | 260/397.25 |
| 4,670,285 | 6/1987 | Clandinin et al. | 426/602 |
| 4,692,280 | 9/1987 | Spinelli et al. | 260/420 |
| 4,698,185 | 10/1987 | Dijkstra et al. | 260/403 |
| 4,857,236 | 8/1989 | Gunther | 260/403 |
| 5,084,215 | 1/1992 | Kearns et al. | 260/403 |
| 5,091,117 | 2/1992 | Athnasios et al. | 260/428 |
| 5,106,542 | 4/1992 | Traitler et al. | 554/186 |
| 5,112,956 | 5/1992 | Tang et al. | 530/424 |
| 5,130,061 | 7/1992 | Cornieri et al. | 554/167 |
| 5,250,719 | 10/1993 | Tronconi | 558/146 |
| 5,304,545 | 4/1994 | Mentink et al. | 554/212 |
| 5,342,633 | 8/1994 | Cully et al. | 426/47 |
| 5,424,467 | 6/1995 | Zbam et al. | 554/216 |

FOREIGN PATENT DOCUMENTS

| | | |
|---|---|---|
| 2118893 | 9/1994 | Canada . |
| 2118894 | 9/1994 | Canada . |
| 1559064 | 1/1980 | United Kingdom . |
| WO 89/11521 | 11/1989 | WIPO . |
| WO 91/03946 | 4/1991 | WIPO . |

OTHER PUBLICATIONS

Lanzani et al., *A New Short–Path Distillation System Applied to the Reduction of Cholesterol in Butter and Lard*, J. Am. Oil Chem., Soc., 71, (1994) 609–614.

Abstract of JP 62198351 of Sep. 2, 1987 to Morinaga Milk Ind. Co. Ltd.

(List continued on next page.)

*Primary Examiner*—Shailendra Kumar
*Assistant Examiner*—Deborah D. Carr
*Attorney, Agent, or Firm*—Thomas D. Brainard; Donald O. Nickey

[57] ABSTRACT

Fatty acid esters such as those containing arachidonic acid (AA) and docosahexaenoic acid (DHA) derived from lipid mixtures are prepared with reduced levels of sterols and phosphorus. A preferred embodiment of the invention comprises extracting lipids from egg with methanol; separating lipids including sterols from insoluble egg components; submitting the methanolic solution of lipids to transesterification and subsequent neutralization to convert the lipids to methyl esters of said free fatty acids together with sterols; separating the said sterols and esters from an aqueous phase including phosphorus compounds formed in the transesterification; subjecting the said fatty acid esters and sterols to distillation to separate sterols from the fatty acid esters; and subjecting the said esters to transesterification in the presence of glycerol to produce triglycerides of said esters thereof including that of AA and DHA wherein the resulting triglycerides contain reduced quantities of sterols and phosphorus.

24 Claims, 1 Drawing Sheet

*ESTER ROUTE FOR EGG PHOSPHOLIPID TO TRIGLYCERIDE CONVERSION*

OTHER PUBLICATIONS

Abstract of JP 01160989 (application) of Jun. 23, 1989 to NIOF.

Abstract of Han'guk Ch'uksan Hakhoechi, 1991, 33(8), 602–6 by Han, C.K., et al.

Sim et al., *Egg Uses and Processing Technologies New Development*, CAB International, pp. 115–127 (1994).

Abstract of JP 1131189 of May 24, 1989 to Nippon Oils & Fats KK.

Abstract of JP 1051091 of Feb. 27, 1989 to Nippon Oils & Fats KK.

Abstract of JP 62120340 of Jun. 1, 1987 to Nippon Oils & Fats KK.

Abstracts of JP 62093294 of Apr. 28, 1987 to Hokuren Nogyo Kyodo.

Abstract of JP 60061520 of Apr. 9, 1985 to QP Corp.

Abstract of JP 71042186 of 00000 to Taiyo Food KK.

Abstract of SU 1701737 of Dec. 30, 1991 to Kompleks Poultry Ind. Res. Prodn. Assoc.

Banerjee, et al., *Enrichment of saturated fatty acid containing phospholipids in sheep brain serotonin receptor preparations: use of microwave irradiation for rapid transesterification of phospholipids*, Biochimica et Biophysica Acta., 1110(1992) 65–74.

POLYUNSATURATED FATTY ACIDS AND FATTY ACID ESTERS FREE OF STEROLS AND PHOSPHORUS COMPOUNDS

FIELD OF THE INVENTION

This invention relates to a process for preparing fatty acid and-fatty acid esters high in polyunsaturated fatty acids, which have low concentrations of cholesterol and ether sterols, and phosphorus, and are derived from naturally occurring lipid mixtures. This invention also relates to an enteral nutritional formula containing triglycerides prepared by the process of this invention. The enteral formula can be used as an infant formula or as an adult nutritional.

BACKGROUND OF THE INVENTION

The composition of human milk serves as a valuable reference for improving infant formula. Much effort has been directed at producing a milk based infant formula which is similar to human milk.

One component of human milk that is receiving more investigation is the fat composition. Human milk fat contains long chain polyunsaturated fatty acids which may play a role in infant development. Many infant formulas do not contain lipids having long chain polyunsaturated fatty acids such as arachidonic acid (C20:4w6) (also referred to herein as AA), ecosapentaenoic acid (also referred to herein as EPA), and docosahexaenoic acid (C22:6w3) (also referred to herein as DHA). Acceptable ingredient sources for these fatty acids are limited, thus the lack of such acids in infant formula and adult nutritionals.

Polyunsaturated acids, in particular the longer chain acids such as AA, DHA, and EPA are natural constituents of many foodstuffs. However these acids are either intimately combined with undesirable components such as cholesterol, phosphorus compounds, or are unsuitable for food applications in their functional form.

The n-6 family of polyunsaturated fatty acids, based on the parent linoleic acid and higher derivatives such as AA, have long been established as essential in human and animal nutrition. More recently, evidence has accumulated for the nutritional importance of the n-3 family of polyunsaturated fatty acids, based on the parent linolenic acid and higher derivatives such as ecosapentaenoic acid (EPA) and docosahexaenoic acid (DHA). These polyunsaturated acids are the precursors for prostaglandins and eicosanoids, a powerful group of compounds which produce diverse physiological actions at low concentrations. The prostaglandins are known to influence blood clotting, inflammatory and anti-inflammatory response, cholesterol absorption, bronchial function, hypertension, visual acuity and brain development in infants, and gastric secretions, among other effects.

Egg yolk lipids contain AA (arachidonic acid) and DHA (docosahexaenoic acid) and are widely consumed in diets of both children and adults. Lipids isolated from egg yolks could be deemed unacceptable for use in infant formula due to high levels of cholesterol which suffers from negative public opinion, and the troublesome levels of phosphorus. The AA and DHA are present in egg yolk lipids primarily as phospholipids. Thus, infant formulas fortified with egg yolk lipids exhibit levels of cholesterol and phospholipids which far exceed the level of such nutrients found in breast milk.

Typically, the amount of lipids in egg yolk is about 65% by weight (wt %) of the dry matter. In such lipids, about 66 wt % of the lipid is triglycerides, of which about 30 wt % is phospholipids, and about 4 wt % is cholesterol. The phosphorus content of the lipids is about 1 wt % to 2 wt %.

Several commercial egg lipid ingredients are presently available. The first, OVOTHIN 120, is a total egg yolk lipid extract supplied by Lucas Meyer of 765 East Pythian Ave., Decatur, Ill. 62526. OVOTHIN 120 contains triglyceride, phospholipid and cholesterol. A second ingredient, supplied by Psanstiehl Laboratories, Inc. of 1219 Glen Rock Ave., Waukegan, Ill. 60085 is an egg yolk extract which is 90% phospholipids. Also, purified egg phospholipid is available from Genzyme Corporation of One Kendill Square, Cambridge, Mass. 02139. Unfortunately, all the above ingredients negatively impact the phosphorus levels of infant formula when used at the proper fortification level to achieve AA and DHA target levels approximating the content of AA and DHA in human milk. The proper fortification would require that about 7–9 wt % of the fat in the infant formula be composed of phospholipid. Human milk fat contains 1–3 wt % phospholipid. Furthermore, the use of OVOTHIN 120 increases cholesterol in infant formula above the levels found in human milk.

There are numerous methods in the literature for recovering phospholipids from lipid mixtures. For example, U.S. Pat. No. 4,698,185 discloses a method of separating phospholipids from crude vegetable triglyceride mixtures. The method involves the addition of water in a mass ratio about equal to the mass of phospholipids present in the lipid mixture, with or without heating, and with or without co-addition of citric or phosphoric acid, to cause the phospholipids to hydrate and separate into a second phase.

Such degumming methods, however, were designed for the removal of 1 to 2 weight percent of phospholipids from crude vegetable triglycerides and are not directly applicable to the purification of other natural lipid mixtures, such as egg yolk lipids because of the higher levels of phospholipids (30–40 wt %) in egg yolk lipids. Addition of a 1:1 mass ratio of water to phospholipid with large amounts of phospholipids present causes the formation of a stable emulsion which prevents phase separation. Moreover, sterols tend to partition between both the phospholipid and triglyceride phases.

It is desirable to provide a process by which cholesterol and other sterol compounds (many of which can be metabolized to cholesterol or its derivatives) can be extracted from various foodstuffs, thereby producing low-cholesterol versions of such foodstuffs. However, the process must not introduce into the foodstuff any material which is not generally recognized as safe for use in foodstuffs. In addition, the process should remove from the foodstuff not only cholesterol itself but also cholesterol derivatives and other sterol compounds which can be metabolized in the body to cholesterol or derivatives thereof, and which thus affect cholesterol levels in the body. Furthermore, the process should leave the foodstuff in a form which is as close as possible to that of the original, high cholesterol foodstuff.

Numerous attempts have previously been made to provide a cholesterol-removal process which meets these exacting criteria. U.S. Pat. No. 4,692,280, discloses a process for the purification of fish oils in which the oil is extracted with supercritical carbon dioxide to remove cholesterol, together with odoriferous and volatile impurities. Such carbon dioxide extraction processes, however, suffer from the disadvantage that they must be operated under pressure to keep the carbon dioxide in the supercritical phase, which increases the cost of the apparatus required. In addition, such carbon dioxide extraction processes are not very selective in the removal of cholesterol, and thus remove valuable constituents of the foodstuff.

U.S. Pat. No. 5,091,117 discloses a process for removing at least one sterol compound and at least one saturated fatty acid from a fluid mixture by contacting the fluid mixture with an activated charcoal. U.S. Pat. No. 5,091,117 states however, in column 12, lines 4–19, that the process should not be used for removing cholesterol from materials, such as egg yolks which contain a combination of cholesterol and proteins, since a significant adsorption of proteins and their constituent amino acids occurs on the charcoal.

British Pat. No. 1,559,064 discloses a process for removing cholesterol from butter triglycerides by distillation. However, Lanzani et al [J. Am. Oil Chem. Soc. 71, (1994) 609] determined that only 90% of the cholesterol could be removed using the process disclosed in British Pat. No. 1,559,064 without seriously affecting the quality of the end product. Excessive time at the high temperatures needed for more complete cholesterol removal was found to cause cis-trans isomerization of the polyunsaturated fatty acids. The trans form of polyunsaturated fatty acids are considered undesirable in food products.

Egg yolk is an example of a lipid mixture rich in polyunsaturated fatty acids including AA and (all-cis)-4,7,10,13, 16,19-docosahexaenoic acid (DHA) in which the polyunsaturated fatty acids are predominantly bound in the phospholipids and which contain high levels of cholesterol. It is desirable to provide a process for the manufacture of egg-derived fatty acids and fatty acid esters high in polyunsaturated fatty acids which removes cholesterol and phosphorus residues without degrading or causing cis-trans isomerization of the essential polyunsaturated fatty acids contained therein or the taste and flavor of foods prepared using such fatty acid and ester mixtures. Moreover, the process for the manufacture of the fatty acid and ester mixtures should use materials which are on the Generally Recognized As Safe (GRAS) list of the U.S. Food and Drug Administration in order for the final product to be used in foods.

U.S. Pat. No. 4,670,285 to M. Clandinin of Jun. 2, 1987 discloses the use of lipid extracted from egg yolk in infant formula. The lipids of the Clandinin reference include polyunsaturated lipids found in human milk such as C:20 or C:22 w6 and C:20 or C22 w3 fatty acids. The lipids of Clandinin contain the unacceptable levels of cholesterol and phosphorus of the original egg yolk material.

Abstract of JP 62198351 of Sep. 2, 1987 to Morinaga Milk discloses a substitute mothers' milk composition which contains egg yolk lipid extracted from egg yolk with ethanol. The lipid is preferably combined so that a 100 g milk composition contains 68 mg of cholesterol. However, the 68 mg of cholesterol translates to about 680 mg/L (liter) or greater than four times that found in average composition human milk.

U.S. Pat. No. 5,112,956 of May 12, 1992 to P. Tang, et al. discloses a method for the removal of lipids and cholesterol from protein material such as that in egg yolk by treating the protein with an extraction mixture comprising a lower alcohol, water, and an acid in concentrations selected to extract cholesterol and lipids from the protein. The preferred lower alcohol of this reference is ethanol and a primary object is obtaining protein suitable for human consumption.

PTC publication WO 89/11521 of Nov. 30, 1989 discloses a process for preparing EPA and DHA and their esters from oils of animal and/or vegetable origin by subjecting the raw oil to alkaline hydrolysis, acidifying the soap so formed with a mineral acid in aqueous solution, extracting the resulting mixture with petroleum ether and after washing and concentration, the combined extracts are submitted to one or more distillation steps with the pressure and temperature parameters being suitably changed in order to obtain a whole range of desired products.

Abstract of JP 1160989 (application) of Jun. 23, 1989 to NIOF. Fresh fish eggs are extracted with solvent of distilled water, methanol/chloroform, acetone, ether, under oxygen-free conditions to extract lipids and eventually isolate a docosahexaenoic acid- containing phosphatidylcholine.

Abstract of Han'guk Ch'uksan Hakhoechi, 1991, 33(8), 602–6 by Han, C. K., et al. Egg yolk was ground with trichloromethane and methanol. Lipid extract was converted to methyl esters by transesterification with boron trifluoride and methanol. The methyl esters were analyzed for various fatty acids. C20–22 polyunsaturated acids accounted for 4.3% of the total.

In the present invention, egg yolk derived glyceride compositions, also simply referred to herein as Processed Natural Ingredients, are prepared which typically contain about 4 wt % of AA and about 1.5 wt % of DHA based on the weight of the Processed Natural Ingredients and wherein the amount of phosphorus can be reduced to less than about 1.0 wt % (1000 ppm) and the amount of sterols reduced to less than about 5.0 wt % of the processed Natural Ingredients. The process according to this invention can produce a product that contains less than about 0.002 wt % (20 ppm) and the sterols are less than about 0.1 wt % and wherein the weight-to-weight ratio of AA to sterols is greater than or equal to 1.0. Preferably at least 95% and particularly at least 98% of the cholesterol and other sterols, and phosphorus compounds are removed from the lipid mixture staring material, e.g. egg yolks in the process of this invention, and such highly purified fatty acids or esters thereof are referred to herein as being "essentially free of cholesterol, sterols and phosphorus compounds". The Processed Natural Ingredients can be that of mono-, di-, or triglycerides as well as mixtures thereof. This invention also relates to the product resulting from the process disclosed herein and wherein the product can be characterized as having an AA to sterol weight-to-weight ratio of greater than or equal to 1.0.

Unless the context indicates otherwise, the following terms shall have the following meaning:

"AA" is arachidonic acid (C20:4w6);

"alkaline metal" is an alkaline earth metal or alkali metal such as calcium, magnesium, sodium, or potassium;

"DHA" is docosahexaenoic acid (C22:6w3);

"egg derived triglycerides" are one of the Processed Natural Ingredients (as defined below) wherein a major portion, preferably at least 75% by weight of the glycerides and particularly at least 90% of the glycerides are triglycerides derived from egg yolk;

"ester route" is the process which comprises the preparation of fatty acid esters by transesterifying fatty acids of lipids to lower alkyl esters of the fatty acids;

"essentially free of cholesterol, sterols, and phosphorus compounds" means that at least 95%, preferably at least 98%, of the cholesterol and other sterols, and phosphorus compounds are removed from a lipid starting material by the process of the present invention;

"FAP" is fatty acid profile;

"FAME" is fatty acid methyl esters;

"GC" is gas chromatography;

"lower alkanel" is an alkane having from 1 to 4 carbon atoms;

"lower alkyl" is an alkyl having from 1 to 4 carbon atoms;

"lower alkanol" is a monohydric alcohol having from 1 to 4 carbon atoms;

"lower alkoxide" is an alkyl oxide group having from 1 to 4 carbon atoms such as in sodium methoxide;

"mL" means milliliter;

"N/AP" means not applicable;

"N/D" means not detectable;

"N/R" means not reported; and

"Processed Natural Ingredients" are the compositions containing glycerides prepared by reacting glycerol with the free fatty acids or lower alkyl esters thereof in the process of this invention;

"TLC" is thin layer chromatography.

DISCLOSURE OF THE INVENTION

Figure 1:
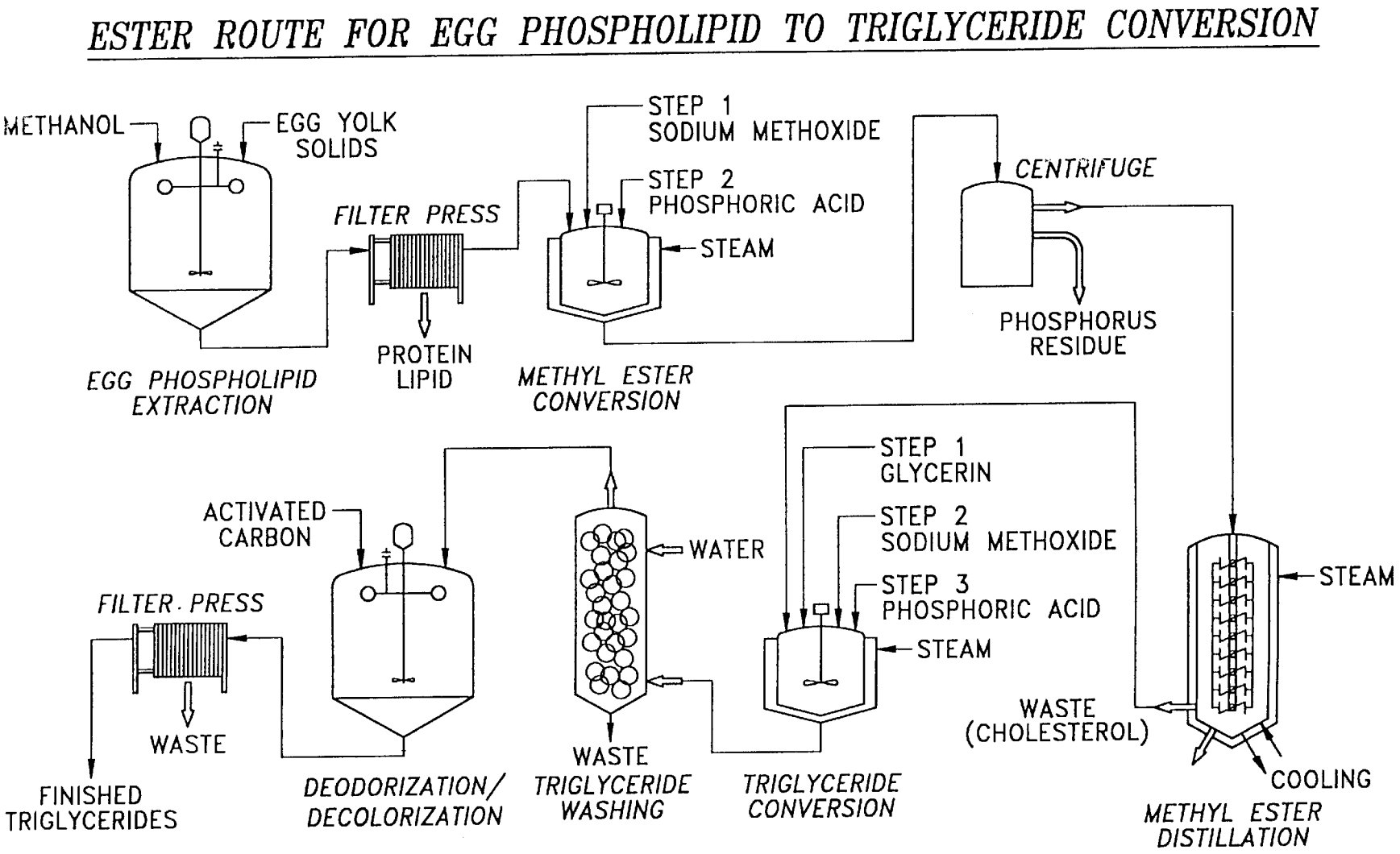
FIG. 1 is a schematic flow diagram entitled "ESTER ROUTE FOR EGG PHOSPHOLIPID TO TRIGLYCERIDE CONVERSION" and shows important steps of a preferred method for making the triglyceride composition of the Processed Natural Ingredients by use of methanol as the extraction solvent for lipids from egg yolk solids by the ester route.

The present invention relates to a process for preparing fatty acid and fatty acid esters as well as mixtures thereof which are high in polyunsaturated fatty acids, which are essentially free of cholesterol and other sterols, and phosphorus, and are derived from lipid mixtures such as naturally occurring lipid mixtures.

The sterols and the phosphorus compounds are removed without degrading or causing cis-trans isomerization of the essential polyunsaturated fatty acids or esters thereof contained therein or the taste and flavor of foods prepared using such lipids mixtures. Moreover, the process of the present invention uses materials which are on the Generally Recognized As-Safe (GRAS) list of the U.S. Food and Drug Administration.

In one aspect of this invention, the process broadly comprises the steps of:

(A) subjecting a lipid mixture containing phospholipids, triglycerides and sterols, including cholesterol to alkaline transesterification with a lower alkanol to produce a lower alkyl fatty acid ester phase comprised of lower alkyl fatty acid esters and sterols and an aqueous phase comprised of water, glycerol and phosphorus compounds;

(B) separating the aqueous phase from the lower alkyl fatty acid ester phase products formed in Step (A);

(C) distilling the fatty acids or esters thereof of Step (B) at a temperature of at lest 100° C. to separate and recover in the distillate lower alkyl esters of the fatty acids wherein said fatty acids or esters thereof have reduced concentrations of cholesterol and other sterols, and phosphorus compounds in relation to the lipid mixture; and (D) subjecting the purified lower alkyl esters from Step (C) to transesterification of the purified lower alkyl ester obtained in Step (C) with a C1–C10 monohydric or polyhydric alcohol to produce a fatty acid ester of said C1–C10 alcohol.

The selection of the specific steps in the chemical synthesis method of this invention compliment each other so as to arrive at the Processed Natural Ingredients in an economic and efficient manner useful in the manufacture of enteral formulas.

In another aspect of the invention, phospholipids having a high concentration of AA are prepared by contacting a natural lipid source, e.g., egg yolk and preferably egg yolk solids, with a solvent consisting essentially of methanol at a temperature of about 20° C. to 68° C.

In another aspect of the invention a lower alkanol is included with the lipid mixture to assist or cause the mixture to separate into a top phase comprising phospholipids, sterols and alcohol and a bottom phase comprising triglycerides and sterols. The top phase is then used for subsequent processing.

In still another aspect of the invention the egg yolk is extracted with a lower alkyl alcohol and the subsequent processing follows the same steps as for that described above. The use of methanol to extract lipids is advantageous, particularly at temperatures from about 20° C. to the boiling point of methanol, i.e., 68 degrees C., since the amount of AA extracted is unexpectedly greater in comparison with the use of other alkanols such as ethanol or propanol. Additionally, methanol is a solvent accepted for use in preparation of food ingredients.

In a further aspect of the invention purified lower alkyl esters of the fatty acids are recovered from the distillation step without proceeding to the esterification step.

Still further aspects of the invention include fractionation techniques for concentrating fatty acids such as AA and DHA.

A number of techniques were unsuccessfully tried to obtain glycerides of AA and DHA in an economic and practicable manner which would be suitable for use in an enteral formula such as infant formula. One of the unsuccessful techniques was thermal cracking. When egg yolk lipids and water were mixed and heated, there was a severe foaming problem. When water was limited to one equivalent based on phospholipid, foaming could be controlled. After 5 minutes at 250° C. with no solvent, TLC (thin layer chromatography) showed a mixture of triglyceride and diglyceride and starting material (phospholipid). However, the reaction mixture was very dark in color and non-homogeneous. The dark color was indicative of decomposition. Lowering the temperature to 200° C. for 30 minutes showed no obvious benefits.

Still another advantage of this invention is the finding that temperatures of up to about 250 degrees C. can be used in some of the method steps without decomposition or appreciable darkening of the AA and DHA or methyl esters thereof. This is believed to be unexpected since a test conducted with methyl oleate began to darken at about 75° C.

DETAILED DESCRIPTION OF THE INVENTION

Naturally occurring lipid mixtures high in polyunsaturated fatty acids are derived from animal and vegetable matter. Sources of lipid mixtures include: marine animals such as blue-colored fish, e.g., the mackerel, sardine, mackerel pike and herring; salmon; cod liver oil; animal marine plankton, such as krill and the various shrimp-like copepods; eggs; green leafy vegetables such as spinach, broccoli, and purslane; and oilseeds such as soya, sunflower, flax, canola, rapeseed, and cotton seeds. Any source of lipid mixtures high in polyunsaturated fatty acids may be used in the process of the present invention.

The lipid mixture is separated from the animal or vegetable fat or oil by extraction or leaching with a solvent such as alcohol or hydrocarbon. Illustrative of solvents for leaching or extracting lipids there can be mentioned lower alkanols having from 1 to 4 carbon atoms such as methanol, ethanol, isopropanol, and the like; hydrocarbons such as hexane; ethers such as petroleum ether and diethyl ether; lower alkanes under pressure such as those having from 3 to 4 carbon atoms and halogen substituted lower alkanes such as trichloromethane and dichloromethane; ketones such as acetone; as well as mixtures of the foregoing. For example, egg yolk powder may be mixed with a lower alkanol, e.g., methanol, which yields a lipid mixture containing phospholipids, triglycerides and sterols in liquid form, and solid protein material. The solid protein material is easily separated from the lipid mixture by methods known in the art such as filtration or centrifugation.

The preferred lipid source is egg yolks. The egg yolks used in this invention are generally derived from various avian species such as the hen, turkey, etc. and preferably the hen. However, eggs of other animals can be used, e.g. that of fish such as salmon eggs as well as eggs of turtles.

A typical composition of hen's egg yolks as found in Sim, J. S. et al., Egg Uses and Processing Technologies, page 120 (1994) is as follows on a percent by weight basis:

(a) 47.5% water, 33.0% lipids, 17.4% protein, 0.20% of carbohydrates (free), 1.1% of inorganic elements; and others of 0.8%;

(b) as to lipid composition (from total lipids): triglycerides of 71–73%, cholesterol of 4–6%, phospholipids of 23–25%, lecithin (in phospholipids) of 70–77%, C16–18 fatty acids 99.5%, saturated fatty acids 44%, monounsaturated fatty acids 44% and polyunsaturated fatty acids of 10.2%. As far as the C16 and C18 fatty acids are concerned in the preceding egg yolk analysis, it does not appear to applicants that the analysis accounted for long chain fatty acids.

Egg yolks can be in different forms such as liquid, frozen, or solid with or without conventional additives such as silica flow agents. Egg yolk solids can be obtained from eggs by various conventional means such as by spray drying egg yolks, freeze drying, etc. Egg yolk solids typically have 5% maximum moisture content, a pH of 6.5±3, a 56.0 wt % minimum fat content, protein of 30 wt % minimum. A preferred form of egg yolk useful in the present invention is egg yolk solids.

The long chain unsaturated fatty acids such as AA and DHA in egg yolk lipids are found predominantly in the phospholipid fraction. In the methanol solution of the egg yolk lipids of this invention, the amount of lipids is typically about 38 wt %; the amount of AA is about 4 wt %; and the amount of DHA is about 1.5 wt % as determined by a relative fatty acid profile. However, the quantity of these lipid components can vary depending on the species of animal, its diet, time of year, etc.

The amount of phosphorus and cholesterol contained in the Processed Natural Ingredients is very low. Generally, the quantity of phosphorus can vary from about 1.0 wt % to 0.0001 wt % based on the Processed Natural Ingredients. It is preferred that the quantity of phosphorus be less than 0.1 wt % and particularly less than 0.01 wt % of the Processed Natural Ingredients. Generally, the quantity of sterols contained in the Processed Natural Ingredients is low. Generally, the quantity of sterols can vary from about 5.0 wt % to 0.001 wt % based on the Processed Natural Ingredients. Further, the product produced according to this invention has a weight-to-weight ratio of AA to sterols of equal to or greater than 1.0. It is preferred that the quantity of sterols including cholesterol be less than 0.5 wt % and particularly less than 0.1 wt % based on the weight of the Processed Natural Ingredients. The distilled lower alkyl esters of this invention will also have the low phosphorus and low cholesterol levels give above for the Processed Natural Ingredients. It is particularly preferred that the fatty acid and ester products of this invention be essentially free of cholesterol, sterols and phosphorus compounds.

The quantity of organic solvent used for extracting lipids from a lipid source, can vary over a broad range sufficient to dissolve the lipids. In the case of egg yolk solids, such quantity can vary from about 40 ml to over 800 ml of methanol based on 100 grams (g) of egg yolk solids. Larger quantities of methanol can be used but such larger quantities serve little useful purpose since it needs to be removed in later steps of the process.

As can be seen in Example 4 herein the use of methanol to extract lipids from egg yolk provides an unexpected high concentration of AA in the egg lipid extract in the temperature range of about 20° C. to 68° C. and preferably 30° C. to 65° C.

By extracting egg yolk with methanol, a phospholipid-rich egg lipid extract is obtained. It is the phospholipids which contain most of the AA and DHA of the egg yolk. When a solvent other than methanol is used for extracting the lipids, the extraction temperature can vary from about 0° C. to the boiling point of the solvent. The quantity of such other organic solvent can be the same as in the use of methanol.

The addition of a lower alkanol as used in the extraction of lipids from a lipid source or when simply added to a lipid mixture from which the triglycerides have not been separated from the phospholipids before transesterification causes the formation of two liquid phases when the temperature is maintained between 20° C. and 68° C., preferably 30° C. to 65° C. The top phase is comprised of phospholipids, sterols, and alcohol, the bottom phase is comprised of triglycerides and sterols. The triglyceride phase is removed by methods known in the art such as decantation. For lipid mixtures such as egg yolks in which the polyunsaturated fatty acids such as AA, DHA and EPA are predominantly bound in the phospholipids rather than the triglycerides, the addition of the alcohol is convenient and inexpensive method of removing the triglycerides and concentrating the polyunsaturated fatty acids in the remaining lipid mixture. The addition of the lower alkanol does not interfere with the subsequent transesterification reaction and can provide the lower alkanol needed for transesterification of the fatty acid portion of the phospholipid. In case methanol is used as the lower alkanol for the phase separation, the methanol is preferably added in a mass ratio of about 0.5 to 1 to 3 to 1 alcohol to the source of the lipids, e.g., egg yolk solids. The addition of methanol outside this range either does not result in the formation of a two phase mixture or results in poor partitioning of triglycerides and phospholipids into their respective phases. Water can be used to assist in such separation and the quantity of water can vary over a wide range such as that of from about 1 wt % to about 100 wt % based on the source of the lipids, e.g., egg yolk solids.

This invention also relates to a method for extracting and concentrating phospholipids having a high AA content from egg yolk which comprises:

(A) contacting egg yolk with a solvent consisting essentially of methanol at a temperature of about 20° C. to 68° C. to form a solution of egg yolk lipids in methanol and wherein the quantity of methanol is in a mass ratio of 0.1:1 to 3:1 of methanol to egg yolk solids;

(B) separating the lipid solution from insoluble egg yolk components; and (C) separating phospholipids from triglycerides in the lipids.

A brief description of a preferred embodiment of the invention involving the ester route is as follows. Lipids are extracted from a lipid source, e.g.,egg yolk solids, with methanol; the lipids are separated from proteins and other insoluble constituents of the lipid source; the methanolic solution of lipids is submitted to alkaline transesterification and subsequent neutralization to convert the fatty acids of lipid glycerides into fatty acid methyl esters wherein the reaction medium also contains sterols such as cholesterol as well as glycerine, phosphorus, and other products in the lipids or resulting from the transesterification and subsequent neutralization; the methyl esters and sterols of the foregoing are separated, such as by precipitation or phase separation, from an aqueous phase which includes phosphorus from the lipids, principally from phospholipids, as well as glycerine and some of the methanol; the methyl esters are distilled to separate sterols from the methyl esters; and the methyl esters are subjected to esterification, specifically transesterification, in the presence of glycerol and subsequent neutralization or quenching of the reaction product to produce the egg derived triglycerides of fatty acids from the egg yolk lipids wherein such triglycerides have a high concentration of AA and DHA ester groups and wherein such egg derived triglycerides contain reduced quantities of cholesterol and phosphorus.

After the lipids are dissolved in the methanol or other organic solvent, the insoluble egg yolk components such as protein are separated from the methanolic solution of lipids. This can be done by various conventional techniques such as the use of a filter press, centrifuging, vacuum filtration, etc.

In the case of egg yolk is extracted with methanol, the extract is preferably separated into a triglyceride phase and a phospholipid phase by the addition of water and centrifuging. Analysis of a sample with methanol as the solvent for extracting the lipids showed that the triglyceride phase had no detectable phosphorus and was low in cholesterol. A fatty acid distribution assay of such sample showed that the triglyceride phase contained only 0.37% AA and 0.13% DHA. This demonstrates that the phospholipids were cleanly separated from the triglyceride fraction. With the separation and isolation of the phospholipid phase, a large percentage of triglyceride can be removed and final products such as the purified free fatty acids, lower alkyl fatty acid esters and Processed Natural Ingredients can be prepared with a higher concentration of the polyunsaturated acids such as DHA and AA.

Although separation of phospholipids from triglycerides as described above prior to transesterification is advantageous, it was found that the majority of cholesterol also separated into the phospholipid layer. Thus, an effective method for removing the cholesterol and other sterols from this or subsequent reaction mixtures needs to be used.

In the ester route, after removal of insoluble material from the lipid source, the solution of lipids, preferably phospholipids such as those separated from egg yolk triglycerides, are then ready for transesterification with a lower alkanol and a catalytic quantity of an alkaline metal lower alkoxide. In case the lipid is not dissolved in a lower alkanol, such alkanol needs to be added for the transesterification. Lipid solvents other than lower alkanols should preferably be removed at this step. At this stage neutralization might be required because egg yolk lipids are typically slightly acidic. The alkaline metal portion of the alkoxide of the transesterification catalyst can be that of an alkaline earth metal or alkali metal such as calcium, magnesium, sodium or potassium. Preferred alkaline metals are those of sodium or potassium and particularly that of sodium. The lower alkyl oxide, i.e., the alkoxide, can have from 1 to 4 carbon atoms and preferably from one to 2 carbon atoms, e.g., methyl, ethyl, propyl, isopropyl, butyl, isobutyl, etc. Illustrative of the alkaline metal lower alkoxides there can be mentioned those of sodium methoxide, sodium ethoxide, sodium n-propoxide, potassium methoxide, potassium ethoxide, and the like.

The quantity of the alkaline metal lower alkoxide catalyst can vary over a wide range sufficient to neutralize the lower alkanol solution of lipids as well as providing a catalytic amount for effecting the transesterification of the lipids in the lower alkanol to the corresponding lower alkyl esters of the fatty acids in the lipids. Alternatively, the acidity in the alcoholic solution of lipids can be neutralized with other basic materials such as calcium oxide and then an alkaline metal lower alkoxide is used in a catalytic amount, e.g., about 0.4 wt % of sodium methoxide based on the weight of lipid.

The temperature for the transesterification of lipid to lower alkyl esters of the fatty acids such as that of AA or DHA can vary over a broad range such as that of about 20° C. to the boiling point of the lower alkanol, e.g., 68° C. in the case of methanol, and preferably at a temperature of about 50° C. to the boiling point of the lower alkanol.

After the transesterification of lipids to the lower alkyl esters of the corresponding fatty acids, the reaction medium is preferably neutralized with an acid, as is conventional with transesterification reactions. However, such neutralization is not necessary. Illustrative of acids which can be employed are inorganic acids such as phosphoric, hydrochloric, sulfuric, etc. as well as organic acids such as acetic, and the like.

Transesterification of the lipids produces an aqueous phase containing phosphorus compounds, generally as precipitates, and lower alkanol and glycerine. There is also produced a lower alkyl ester phase which contains the fatty acid esters and sterols such as cholesterol. The aqueous phase material including precipitates is separated from the phase containing the lower alkyl esters of the fatty acids and the cholesterol. The precipitate is preferably separated by filtration or by centrifuging whereas liquid materials can be separated by means such as decanting, or centrifuging. Although much of the lower alkanol is removed at this stage, about 5 wt % to 10 wt % of the crude lower alkyl ester fraction is lower alkanol. The lower alkanol can be removed by evaporative means. Thus, after neutralization of the transesterification reaction, two distinct layers will form (i.e., phase separation). The upper layer is principally crude lower alkyl esters of the fatty acids, however, it contains some quantity of lower alkanol such as about 2 to 20%. The lower alkanol is removed by evaporation or distillation prior to the distillation of the alkyl esters of the egg yolk fatty acids. Once the above two phases are separated, the lower layer, principally dark (brownish) in color, contains a majority of the alkanol. Upon extended standing or removal of some alkanol, additional amounts of crude lower alkyl esters can be isolated, thus increasing the effective yield.

The crude lower alkyl esters of the fatty acids are then separated from the cholesterol by distillation under reduced pressure such as with a molecular or short path still. Since unsaturated fatty acids such as AA and DHA are sensitive to temperature in that they degrade, particularly in formation of trans isomers, the distillation is preferably conducted at a temperature of 100° C. to about 250° C. The distillation equipment is preferably of the type which permits distillation at low temperature and reduced pressure such as in the use of molecular distillation or short path distillation. Preferably, the distillation is conducted at a temperature of 130° C. to 230° C. The pressure can vary from about $1.0\times10^{-3}$ kPa to $5.3\times10^{-1}$ kPa to recover the purified lower alkyl esters of the fatty acids from the distillation.

After distillation of the lower alkyl esters of the fatty acids, such esters are then converted to other esters, e.g., glycerides by transesterification, with the removal of lower alkanol, preferably in the presence of catalytic quantities of an alkaline metal lower alkyl oxide.

The purified (distilled) lower alkyl esters of the fatty acids which are transesterified with a monohydric or polyhydric alcohol are generally in a molar ratio of 1 to 2 moles of the lower alkyl ester of the fatty acid to each hydroxyl equivalent of the alcohol in the transeterification reaction. In order to minimize formation of mono- and diglycerides in the preparation of triglycerides, it is preferred that the quantity of glycerol in the preparation of the egg derived triglycerides be no more than about 95% of the stoichiometric quantity required for formation of the triglycerides.

The temperature used for the transesterification reaction of the lower alkyl esters of the fatty acids should be no higher than about 250° C. and preferably no higher than 200° C. since the double bonds in the polyunsaturated fatty acids are heat labile and can be converted from cis to trans isomers. Thus the temperature of the transesterification can vary over a wide range such-as that of from about 75° to 250° C. and preferably about 150° to 200° C. An alkaline metal lower alkoxide is again used in catalytic quantities for the transesterification to glycerids and other esters.

After the formation of the glycerides, or other esters in the transesterification reaction are produced, the reaction medium is neutralized with an acid as in the case of the transesterification above for the formation of the lower alkyl esters of the fatty acids from lipid mixtures or phospholipids. The neutralized reaction medium is then treated to remove waste materials and recover a composition containing esters, e.g., glycerides, of the lipid source, e.g., egg yolk fatty acids, including that of AA and DHA, i.e., the Processed Natural Ingredients. Conventional techniques can be used for this purification, e.g., such as washing the neutralized reaction medium with water, after which the lipid is dried with heat, vacuum or both. The Processed Natural Ingredients will contain at least 1 wt % of AA such as about 1 wt % to 15 wt % of AA and at least 0.1 wt % of DHA such as about 0.1 wt % to 5 wt % of DHA and less than 1.0 wt % of phosphorus and less than 5.0 wt % of cholesterol. Preferably, the ingredient produced according to this invention contains less than 0.1 wt % phosphorus and less than 0.5 wt % of the sterols including cholesterol. The product produced according to this invention is further characterized in having a weight-to-weight ratio of AA to sterols (including cholesterol) of greater than or equal to 1.0.

It is envisioned that the product produced in accordance with this invention can be further processed to concentrate the levels of AA and DHA. Such additional processing includes freeze fractionation, super critical extractions and enzymatic transesterification.

After removing wastes from and drying the glycerides, the glycerides are optionally subjected to decolorization such as by contact with activated carbon and the solids from such process then removed, e.g., by a filter press to recover the Processed Natural Ingredients which contain the glycerides of AA and DHA together with small quantities of cholesterol and even smaller quantities of phosphorus. Additionally the decolorized glycerides can be deodorized to remove all volatile components such as free fatty acids, or lower alkyl ester thereof, and residual solvent. Such processing is typical for the production of edible glyceride oils.

In the ester route, it is often desirable to increase the ratio of the unsaturated fatty acids or lower alkyl esters thereof in relation to the saturated fatty acids or lower alkyl esters thereof. As shown in Examples 5, 6, and 7 hereof, this can be accomplished by various fractionation techniques such as solvent fractionation, solid fractionation such as cold pressed techniques, etc. Such fractionation can rely on the melting or solidification temperatures of the egg yolk saturated fatty acids and esters thereof in relation to the unsaturated egg yolk fatty acids and esters thereof. The fractionation can be applied to the crude free fatty acids or the lower alkyl esters thereof before the distillation step or to the purified free fatty acids or lower alkyl esters thereof after distillation.

The concentration of glycerides in the Processed Natural Ingredients can vary from that of at least about 60%, preferably at least about 70% and particularly at least 85 to 90% based on the weight of the Processed Natural Ingredients composition. The remainder is generally that of various reactants, intermediate products and solvents used in the method of this invention together with the small amounts of cholesterol and phosphorus. Illustratively, such remainder can contain: alkanols and various other solvents as well as unreacted fatty acids or lower alkyl esters thereof.

The following examples are illustrative of the invention. All parts and percentages in the examples, as well as elsewhere in this application, are by weight. Room or ambient temperature is 23 degrees C., unless the context indicates otherwise.

EXAMPLE 1

Preparation Of Egg Derived Triglecerides By Ester Route

Type Y-1 Egg yolk solids of Henningsen Foods, Inc. of 14334 Industrial Road, Omaha Nebr. were used in this example. Such egg yolk solids have the following chemical and physical standards: moisture of 0.5% maximum; pH of 6.5±0.3; fat of 56% minimum; protein of 30% minimum; color of 40–60 ppm Beta-carotene; and granulation so that 100% passes through U.S.S.S. #16 screen. Egg yolk solids (455.7 g) Henningsen Foods type Y-1 were placed in a beaker (2 liters [L]) with methanol (1 L), heated to 60° C. and stirred with a magnetic stir bar. The yellow slurry was stirred for 1 hour and after a brief cooling period the solids were removed by vacuum filtration. The insoluble egg yolk components contained in the funnel were washed with an additional amount of methanol (2×200 ml). The filtrate was placed in a 3-neck round bottom flask (1 L)and a portion of the methanol was removed by distillation so that all the filtrate could by accommodated by the one liter flask. The acid content of the methanol lipid mixture was determined by titremetric measurement and an equal number of moles of sodium methoxide was added so as to neutralize any acid. An additional amount of sodium methoxide (1 g) was added to act as catalyst for the transesterification of the egg lipids to methyl esters. After approximately one hour the reaction was complete as determined by TLC (thin layer chromatography) indicating that all of the egg lipids had been converted to methyl esters. The reaction was quenched by the addition of phosphoric acid (0.7 g). The acid addition caused the formation of a precipitate. After cooling the precipitate was removed by vacuum filtration. The filtrate separated into two phases. The upper orange layer contained mostly methyl esters and a small amount of methanol solvent. The lower dark layer contained some methyl esters and most of the methanol. The lower layer was nearly water dispersable. After removal of the excess methanol from the lower layer, an additional amount of the crude methyl esters could be isolated. The combined crude methyl esters (82.4 g) were distilled with a short path glass evaporator (UIC Inc., KDL-4 Unit) at vacuum of 0.045 mm Hg and jacket temperature of 100° C. This clear and colorless distillate (60.4 g) of purified egg derived methyl esters contained 0.46 wt % cholesterol and less than 5 ppm of phosphorus. The purified methyl esters (45 g) were combined with glycerin (4.6 g) in a 3 neck round bottom flask (100 ml). The flask was purged with nitrogen and a nitrogen atmosphere was maintained throughout. The immiscible mixture was stirred vigorously with a magnetic stir bar. After drying the mixture at elevated temperatures, sodium methoxide (0.5 g) was slowly added to the reaction mixture. Heating was maintained between 110°–170° C. for 24 hours. TLC indicated that the reaction was slowly proceeding. An additional amount of sodium methoxide (0.2 g) was added and heating continued an additional 24 hours. Afterwards the reaction mixture was cooled and neutralized by the addition of 85% phosphoric acid (0.5 g). The mixture was washed with water (5×20 ml) and dried with heat and vacuum. The oil was deodorized with a short path glass evaporator to remove all volatiles including unreacted methyl esters in order to obtain the egg yolk derived triglycerides.

TABLE 1

This table sets forth the composition of the egg derived triglycerides prepared in Example 1. The extracted lipids from the egg powder dissolved in methanol are referred to as "Extract"; and the decolorized and deodorized triglyceride egg derived triglycerides referred to as "Purified Triglyceride". This table also shows quantities of fatty acids and cholesterol obtained in another experiment involving the method of this invention for a crude triglyceride before deodorization and decolorization which is simply referred to as "Crude Product". The quantitative results are expressed as grams in 100 grams of sample. The designation "N/D" means that the quantity was not detectable whereas "N/R means not reported.

| | Extract | Distilled Methyl Esters | Crude Product | Purified Triglyceride |
|---|---|---|---|---|
| Cholesterol | 2.786 | 0.465 | N/D | N/D |
| Fatty acids | | | | |
| C14:0 | 0.156 | 0.347 | 0.303 | 0.310 |
| C14:1 | 0.025 | 0.066 | N/R | N/R |
| C15:0 | 0.037 | 0.080 | N/R | N/R |
| C16:0 | 13.790 | 27.051 | 24.821 | 23.371 |
| C16:1 | 1.148 | 2.586 | 2.370 | 2.250 |
| C16:2 | 0.024 | N/R | N/R | N/R |
| C16:3 | 0.080 | 0.172 | 0.162 | 0.152 |
| C16:4 | 0.073 | N/R | N/R | N/R |
| C18:0 | 5.912 | 9.925 | 9.344 | 8.725 |
| C18:1 | 18.695 | 36.121 | 34.095 | 31.969 |
| C18:2 | 7.875 | 14.203 | 13.213 | 12.361 |
| C18:3 | 0.192 | 0.331 | 0.264 | 0.248 |
| C18:4 | 0.067 | 0.058 | 0.187 | 0.176 |
| C20:0 | N/R | 0.030 | N/R | N/R |
| C20:1 | 0.123 | 0.223 | 0.210 | 0.206 |
| C20:2w6 | 0.152 | 0.157 | 0.219 | 0.224 |
| C20:3w6 | 0.178 | 0.264 | 0.243 | 0.233 |
| C20:4w6 (AA) | 2.096 | 2.882 | 2.500 | 2.367 |
| C20:5w3 | N/R | 0.032 | N/R | N/R |
| C21:5 | 0.036 | N/R | R/R | N/R |
| C22:4w6 | 0.130 | 0.141 | 0.123 | 0.123 |
| C22:5w6 | 0.493 | 0.636 | 0.453 | 0.439 |
| C22:5w3 | 0.070 | 0.083 | N/R | N/R |
| C22:6w3 (DHA) | 0.675 | 0.616 | 0.612 | 0.596 |
| TOTAL | 52.026 | 96.568 | 89.124 | 83.750 |

EXAMPLE 2

Preparation Of Egg Derived Triglicerides By Ester Route

Egg yolk powder (8 batches of 500 g, or 4,000 g total) was mixed with methanol (8 batches of 1,000 ml, or 8,000 ml total) and heated to 50–60 degrees C. with stirring. The egg powder did not freely disperse in the methanol, and the clumps of egg powder had to be broken up via a spatula. The extraction time averaged about 45–60 minutes before the slurry was filtered through a Buchner funnel. The egg protein filtered very quickly, and an additional 200 ml of methanol (per batch) was used to wash the insoluble egg yolk components.

By isolation of the extract in a separate experiment, the acid value of the extract was about 12. In order to reduce the usage of sodium methoxide for the transesterification, 21.6 g of calcium oxide was added. This amount of calcium oxide was enough to neutralize an acid value of 12, assuming that the weight of the extract is 50 wt % of the egg powder. Afterward the yield of the extract from egg powder was estimated to be about 33 wt % and therefor an excess of calcium oxide was probably used.

To initiate the transesterification, 36 ml of 25% sodium methoxide in methanol was added to the methanol solution at room temperature. Within one hour, the reaction was nearly complete, but the reaction was stirred overnight for convenience. There was not a glycerol layer in the bottom of the reaction flask as would be normally expected, but there were calcium salts suspended in the mixture. Acetic acid (9.45 g ) was added to neutralize the sodium methoxide before the removal of methanol. Methanol was removed by distillation by heating the reaction mixture up to a temperature of 75 degrees C., and finally heating under vacuum.

The residue was poured into centrifuge bottles, and placed in a centrifuge set to run at 4,000 rpm for 15 minutes at room temperature. After'centrifugation, there were two phases in the bottles, and the dark orange upper layer was decanted from the calcium salt residue. The calcium salt residue weighed 382 g. The orange colored upper layer was not totally homogeneous, and it appears that cholesterol was crystallizing out.

The orange colored decantate was diluted with about 275 g of triglyceride oil previously isolated from the egg yolk phospholipids. This nonvolatile triglyceride oil was added to lubricate the rotors of the Pope still because of the high cholesterol concentration of the decantate. The decantate was added to the still. At a vacuum of 1 mm Hg, the distillation was conducted at a temperature of 200±20 degrees C. This temperature is the set point of an external heating mantle on the Pope still, and this is not the temperature where the methyl esters actually distill.

From this distillation was obtained, 820 g of distilled methyl esters. These methyl esters contained 0.3% cholesterol by GC (gas chromatography) assay, and the distillate turned into a semi-solid upon standing. The residue weighed 489 g. From these isolated yields, one obtains the following:

| | |
|---|---|
| Calcium salt residue | 382 grams |
| distilled methyl esters | 820 grams |
| distillation residue | 489 grams |
| triglyceride diluent | −275 grams |
| calcium oxide added | −21 grams |
| sodium methoxide | −10 grams |
| acetic acid | −10 grams |
| Total isolated weight | 1375 grams |

This isolated weight shows that the extract weight was about 30 wt % based on egg powder.

About 741 grams of the distilled methyl esters was used for the final esterification. This distillate was mixed with 82 g of glycerol and 10 ml of 25% sodium methoxide. The esterification reaction started at 75° C., and was gradually increased. The temperature was started this low because analogous esterifications with methyl oleate began to darken increased to 170 degrees before the reaction was terminated. After 7 days of constant heating, there was no sign of major decomposition, and the product color was very light. The reaction mixture was cooled to 75 degrees and 4.5 g of 85% phosphoric acid was added to neutralize the sodium methoxide catalyst, and then hot water (400 ml) was added to wash away the acid salts. Two additional hot water washes were used to remove the salts. Hot water was necessary to reduce the formation of emulsions. The product was then heated to 95 degrees C. under vacuum to degas and dry the sample. This product, referred to herein as the egg derived triglycerides weighed 711 g, but this number is not an accurate yield because much of the reaction mixture was removed during sampling to analyze the progress of the reaction.

A small portion of the final product above was removed and heated to liquify the methyl esters. The sample was treated with activated carbon, and later filtered through a bed of Celite in order to decolorize it. There was a slight improvement in the color by carbon treatment.

About 120 grams of decolorized product was added to the molecular still to remove the unreacted methyl esters in order to deodorize the product. After deodorization, 87.6 g of triglyceride residue and 12.6 g of methyl ester was isolated. The lost 20 grams is not indicative of the process, and it is only the holdup and loss after small scale distillation. However, the lost 20 grams is mostly methyl ester. Analysis of the product obtained by the process of this Example 2 showed the presence of AA and DHA in a higher than expected amount. The methyl ester product was remarkably stable and there was no apparent decomposition or darkening during the glycerol esterification reaction. The decolorized and deodorized triglycerides appeared to have darkened slightly during the distillation. Decoloration may not be necessary, but it appears that if performed that it be done last.

Table 2 below shows the fatty acid content of various compositions from Example 2 as a percent of total fatty acid as obtained by analyzing the fatty acid methyl esters (FAME) of the various compositions indicated in the table.

TABLE 2

| FAME | Final Product Triglycerides | Distilled Esters | Starting Material Egg Powder Extract |
|---|---|---|---|
| 14:0 | 0.14 | 0.11 | 0.31 |
| 16:0 | 22.35 | 20.90 | 27.63 |
| 16:1 | 1.84 | 1.71 | 0.53 |
| 16:3 | 0.16 | 0.16 | 0.15 |
| 16:4 | N/R | N/R | 0.15 |
| 17:0 | 0.22 | 0.22 | 0.22 |
| 18:0 | 11.76 | 11.90 | 11.25 |
| 18:1 | 40.09 | 40.32 | 36.75 |
| 18:2 | 15.42 | 15.35 | 15.10 |
| 18:3w6 | 0.12 | 0.12 | N/R |
| 18:3w3 | 0.29 | 0.29 | 0.26 |
| 18:4 | 0.18 | 0.18 | 0.14 |
| 20:1 | 0.32 | 0.37 | 0.24 |
| 20:2 | 0.29 | 0.38 | 0.27 |
| 20:3 | 0.32 | 0.41 | 0.29 |
| 20:4w6 (AA) | 3.85 | 4.23 | 3.92 |
| 22:0 | N/R | 0.13 | 0.14 |
| 22:4 | 0.26 | 0.35 | 0.24 |
| 22:5w6 | 1.02 | 1.18 | 0.98 |
| 22:5w3 | 0.11 | 0.21 | 0.15 |
| 22:6w3 (DHA) | 1.27 | 1.47 | 1.26 |
| Total | 100.00 | 100.00 | 100.00 |

EXAMPLE 3

Egg Power Extraction Of Lipid With Various Solvents

| Solvent | Temperature | Yield % (fat) | % AA |
|---|---|---|---|
| 2:1 $CHCl_3/CH_3OH$ | 50–60° C. | 64.2 | 2.0 |
| Isopropyl alcohol | 50–60° C. | 60.0 | 1.8 |
| Methyl alcohol | 50–60° C. | 37.3 | 4.2 |
| Ethyl alcohol | 50–60° C. | 57.2 | 2.2 |
| Ethyl alcohol | 22° C. | 41.1 | 2.7 |
| Ethyl alcohol | 4° C. | 25.2 | 3.7 |

The above extractions were performed similarly to the extraction described in Example 1. It can be seen from the above table that mixture of trichloromethane and methanol gave a high yield of total fat but the AA was only 2.0% in the fat. The methyl alcohol gave a relatively low yield of total fat but a very high yield of AA in the fat. The isopropyl alcohol as well as the two runs of ethyl alcohol at 50–60 and 22° C. give relatively high yields of total fat but small yields of AA in the fat. The ethyl alcohol at 4 degrees C. gave the smallest yield of total fat but a relatively high yield of AA in the fat. It can be seen from the above that at temperatures above about 20 degrees C., the methanol was superior compared to the other solvents in the percentage of AA extracted in the lipids. At 4 degrees C. the percentage yield of AA in the fat had increased for ethanol but the yield was lower at that temperature for ethanol as to total fat and AA in comparison to the methanol.

EXAMPLE 4

Solvent Fractionation Of Distilled Fatty Acids

A sample of distilled egg derived fatty acids (1 g) was dissolved at room temperature in hexane (4 ml). The sample was placed in the refrigerator at a temperature of approximately 5 degrees C. After cooling for two days a white solid had precipitated. A portion of the clear supernatant liquid was isolated and an FAP (fatty acid profile) was obtained. The results are shown below wherein FAME means fatty acid methyl ester; S.M. means starting material, namely, the distilled egg derived fatty acids; and Prod. means the clear supernatant liquid. The acids are merely designated by the number of carbon atoms of the acid and the number of unsaturated groups (after the colon) for the particular acid involved.

| FAME | S.M. | Prod. |
|---|---|---|
| C16:0 | 22.7 | 13.5 |
| C18:0 | 11.6 | 5.2 |
| C18:1 | 40.0 | 47.7 |
| C18:2 | 15.3 | 18.8 |
| C20:4 | 3.8 | 4.9 |
| C22:6 | 1.2 | 1.4 |

From the results of the above Example 4 it can be seen that the solvent fractionation of the distilled fatty acids increased the concentration of the unsaturated fatty acids. The solid precipitate appears to be mostly saturated fatty acids. Thus, this procedure increases the concentration of unsaturated fatty acids such as AA and DHA which in turn reduces the amount of egg derived triglycerides needed in an enteral formula to achieve desired levels of AA and DHA.

EXAMPLE 5

Solvent Fractionation Of Methyl Esters

A sample of egg yolk methyl esters extracted with methanol from egg yolk prior to distillation to remove cholesterol was dissolved in hexane (4 ml ). The sample was placed in the freezer at a temperature of approximately -20 degrees C. After cooling for two days a solid precipitate formed. A portion of the supernatant liquid was isolated and an FAP was obtained. The abbreviations in the below table are the same as those of Example 4 above and again it can be seen that the fractionation increased the concentration of unsaturated fatty acids such as AA and DHA.

| FAME | S.M. | Prod. |
|---|---|---|
| C16:0 | 26.7 | 14.7 |
| C18:0 | 11.6 | 4.2 |
| C18:1 | 36.4 | 46.6 |
| C18:2 | 13.6 | 17.4 |
| C20:4 | 3.7 | 4.8 |
| C22:6 | 0.9 | 1.1 |

EXAMPLE 6

Cold Temperature Fractionation Of Methyl Esters

A sample of distilled egg yolk derived methyl esters (1 g) was placed in a syringe (5 ml.) in which the end was plugged with a small piece of cotton. The plunger of the syringe was inserted and all air was removed from the syringe body. The syringe, containing the sample, was placed in the refrigerator at a temperature of approximately 5° C. After cooling for two days the entire syringe contents appeared to be a solid white mass. The syringe was removed from the refrigerator and pressure was quickly applied to the plunger and a clear liquid fraction was isolated. An FAP of the clear liquid was obtained. The results are shown below wherein the meaning of abbreviations is the same as in Example 4 and again it can be seen that this procedure increases the concentration of unsaturated fatty acids such as AA and DHA.

| FAME | S.M. | Prod. |
|---|---|---|
| C16:0 | 27.8 | 14.4 |
| C18:0 | 10.5 | 4.6 |
| C18:1 | 36.1 | 47.3 |
| C18:2 | 14.6 | 19.0 |
| C20:4 | 3.1 | 4.0 |
| C22:6 | 0.8 | 1.0 |

EXAMPLE 7

Process According To The Invention

Liquid egg yolk (292.5 g; "Easy Eggs", M. G. Waldbaum, Gaylord Minn.) was mixed with ethanol (690 ml) in a one liter beaker and stirred with a magnetic stir bar. The mixture was heated with a hot plate until boiling. Boiling was continued for 10 minutes. The mixture was cooled for several minutes and then filtered with a buchner apparatus. The insoluble egg yolk components were first rinsed with ethanol (100 ml) and then removed from the funnel and stirred in an additional amount of ethanol (250 ml) at room temperature for 5 minutes. The solid material was again filtered and washed with ethanol (100 ml). The combined ethanol solutions were placed in single separatory funnel and allowed to stand undisturbed over night. A phase separation occurred and the lower layer, mostly triglyceride, was removed. The ethanolic solution of egg phospholipids was placed in a 3-neck round bottom flask (1L). Sodium hydroxide pellets (2.56 g) were added to the mechanically stirred solution. Heating commenced and ethanol was removed by simple distillation. After approximately 250 ml of ethanol had been removed by distillation, TLC indicated that the reaction mixture contained a significant amount of ethyl esters. An additional amount of sodium hydroxide pellets (1.5 g ) were added and ethanol distillation continued. After another 125 ml of ethanol was removed, TLC indicated that the reaction mixture contained no ethyl ester and only fatty acids of the original egg phospholipid extract. Heat was removed from the flask and after cooling several minutes, concentrated HCl (6 ml) was added to the mixture in order to neutralize the base. Water was added to the cooled mixture and then the entire solution was extracted with hexane (2×400 ml). The combined hexane extracts were dried with sodium sulfate and the hexane was removed under reduced pressure. A dark orangish oil (14.65 g ) was obtained. The oil was again dissolved in hexane (50 ml) and placed in a refrigerator at a temperature of 0°–5° C. and allowed to stand overnight. A solid fraction precipitated from the hexane solution and was isolated by filtration. The hexane filtrate was placed in the freezer (−20° C.)and allowed to stand for 6 hours. Again, a solid precipitate formed that was isolated by filtration. The filtrate was stripped of solvent under reduced pressure to yield a dark orange oil (6.68 g). GC analysis of the various fractions indicates that the solid materials are principally saturated free fatty acids and the liquid fractions show increasing concentrations of unsaturated fatty acids. Tables 7A and 7B below show the relative fatty acid profile of various samples of this example wherein:

Sample A, also referred to as Folch Ext. is the Folch extract of liquid egg yolks;

Sample B, also referred to as EtOH Trigl., is the triglyceride fraction isolated from ethanol extract;

Sample C, also referred to as EtOH Acids, is the first fraction of crude fatty acids (no cold/solvent fractionation)

Sample D, also referred to as 0C Liq. Frac., is the liquid fraction from 0°–5° C. hexane fractionation;

Sample E, also referred to a −20C Liq. Frac., is the liquid fraction from −20° C. hexane fractionation;

Sample F, also referred to as 0C Solid Frac., is the solid precipitate fraction from 0°–5° C. hexane fractionation; and Sample G, also referred to as −20C Solid Frac., is the solid precipitate fraction from −20° C. hexane fractionation.

The free fatty acids, as prepared above prior to extraction with hexane, can then be distilled to separate such acids from cholesterol, preferably after heating to form cholesterol esters with the free fatty acids. The distillate of purified free fatty acids can then be subjected to esterification with glycerol to prepare the egg derived triglyceride of this invention.

TABLE 7A

| | Relative FAP | | | |
|---|---|---|---|---|
| FAME | Sample A Folch Ext. | Sample B EtOH Trigl. | Sample C EtOH Acids | Sample D 0°C. Liq. Frac. |
| C16 | 26.71 | 25.95 | 28.76 | 22.04 |
| C16:1 | 2.90 | 3.42 | 1.54 | 1.80 |
| C18 | 8.89 | 7.67 | 12.46 | 8.68 |
| C18:1 | 41.31 | 45.19 | 29.72 | 34.88 |
| C18:2 | 14,45 | 14.10 | 16.04 | 18.83 |
| C20:4w6 | 2.10 | 1.03 | 6.27 | 7.44 |

TABLE 7A-continued

| FAME | Relative FAP Sample A Folch Ext. | Sample B EtOH Trigl. | Sample C EtOH Acids | Sample D 0°C. Liq. Frac. |
|---|---|---|---|---|
| C20:5w6 | 0.52 | 0.22 | 1.73 | 2.06 |
| C22:6w3 | 0.47 | 0.20 | 1.70 | 2.02 |
| Total | 97.35 | 97.78 | 99.22 | 97.75 |
| AA/DHA | 4.47 | 5.15 | 3.69 | 3.68 |

TABLE 7B

| FAME | Relative FAP Sample E −20° C. Liq. Frac. | Sample F 0° C. Solid Frac. | Sample G −20° C. Solid Frac. |
|---|---|---|---|
| C16 | 6.24 | 54.97 | 58.68 |
| C16:1 | 2.42 | 0.00 | 0.37 |
| C18 | 1.87 | 32.39 | 27.59 |
| C18:1 | 46.62 | 7.13 | 7.09 |
| C18:2 | 25.41 | 4.00 | 3.55 |
| C20:4w6 | 9.96 | 1.50 | 1.31 |
| 20:5w6 | 2.75 | 0.00 | 0.35 |
| 22:6w3 | 2.68 | 0.00 | 0.33 |
| Total | 97.95 | 99.99 | 99.27 |
| AA/DHA | 3.72 | N/AP | 3.97 |

It can be seen from Table 7B that fractional crystallization of fatty acids in hexane increases the concentration of the unsaturated fatty acids while dramatically reducing the amount of saturated fatty acids.

EXAMPLE 8

Extraction Of Lipids With Methanol And Phase Separation Of Triglicerides From Lipids A 1,000 gal glass-lined reactor equipped with a mechanical agitator, condenser, nitrogen, and vacuum system was charged with 1,000 lb of egg yolk powder and 300 gal of methanol. the resulting mixture was heated to 65° C. and agitated for three hours. After filtering off the protein residue and washing with methanol, the methanol-lipid filtrate was returned to the 1,000 gal reactor and heated with agitation to 45° C. The agitation was stopped and the mixture was allowed to settle for one hour, with the temperature maintained between 40°–45° C. Phase separation spontaneously occurred. The bottom phase was decanted off, sampled, and weighed. Analysis showed the bottom phase to weigh 96 lb and contained 94.9% triglyceride, 509 ppm phosphorus, and a fatty acid distribution on a relative basis of 0.6% arachidonic acid and 0% DHA. The top phase, upon stripping off methanol, weighed 245 lbs, and contained 4% triglycerides, 3.63% phosphorus, and a fatty acid distribution on a relative basis of 6.5% arachidonic acid and 2.0% DHA.

The Processed Natural Ingredients of this invention have utility in enteral formulas, nutritional supplements, parenteral formulas, and can serve as starting materials for various edible emulsifiers such as diacetyltartaric acid and esters of mono- and diglycerides (DHTEM), succinylated mono-diglycerides, and acylated mono- and diglycerides. The free fatty acids or lower alkyl esters of the fatty acids prepared from the egg yolk lipids can also serve as starting materials for the preparation of various other edible lipid ingredients such as polyglycerol esters, propylene glycol esters, sorbate esters, and the like.

Many variations will suggest themselves to those skilled in this art in light of the above detailed description. All such obvious modifications are within the full intended scope of the appended claims.

What is claimed is:

1. A process comprising the steps of:

(A) subjecting a lipid mixture containing cholesterol, phospholipids, triglycerides and sterols to alkaline transesterification with a lower alkanol to form a two phase product containing a lower alkyl fatty acid ester phase comprised of lower alkyl fatty acid esters and sterols and an aqueous phase comprised of water, glycerol and phosphorus compounds;

(B) separating the aqueous phase from the lower alkyl fatty acid ester phase formed in Step (A);

(C) distilling the lower alkyl fatty acid esters and sterols from the lower alkyl fatty acid ester phase of Step (B) at a temperature of at least about 100° C. to separate and recover in the distillate lower alkyl esters of the fatty acids wherein said esters have reduced concentration of cholesterol and other sterols, and phosphorus compounds in relation to the lipid mixture of Step (A); and (D) subjecting the distilled lower alkyl esters to transesterification of the lower alkyl esters from Step (C) in the presence of a C1–C10 alkyl monohydric or polyhydric alcohol wherein said alcohol has a different number of carbon atoms from that used in the transesterification of Step (A) to produce a fatty acid ester of said C1–C10 alcohol.

2. The process of claim 1 wherein the lower alkanol is methanol.

3. The process of claim 1 wherein the lipid mixture is separated into a phase containing phospholipids and sterols and a phase containing the triglycerides and sterols by contacting the lipid mixture with a lower alkanol, separating the phospholipid phase from the triglyceride phase and using the phospholipid phase for the subsequent transesterification of Step (A).

4. The process of claim 1 wherein the lipid mixture of Step (A) is a naturally occurring lipid mixture.

5. The process of claim 1 wherein the lipid mixture is that from the egg yolk of hens.

6. The process of claim 1 wherein the treatment in Step (A) is alkaline transesterification of the lipids with methanol to produce methanol fatty acid esters.

7. The process of claim 1, wherein the lipid mixture of step (A) comprises egg yolk lipids having AA and DHA, and further comprising, prior to step (A), contacting egg yolk with an organic solvent to form a solution of lipids, including sterols, in the solvent; and separating the lipids from insoluble egg yolk components.

8. The process of claim 7, wherein the egg yolk lipids are in the form of solids.

9. The process of claim 7, wherein the organic solvent is a lower alkanol.

10. The process of claim 9, wherein the lower alkanol is methanol.

11. The process of claim 10, wherein said contacting with methanol is effected at a temperature between 20° C. and 68° C.

12. The process of claim 7, further comprising separating the phospholipids from the triglycerides while in the alcoholic solution and using the phospholipid fraction for the transesterification of step (A).

13. The process of claim 7, further comprising separating the phospholipids from the triglycerides while in the alcoholic solution and using the fraction containing the highest concentrations of AA and DHA for the transesterification of step (A).

14. The process of claim 7, wherein said step (C) comprises distilling the sterol fatty acid esters formed in Step (B) at a temperature of 130° C. to 250° C. and a pressure of $1\times10^{-3}$ kPa to $5.3\times10^{-3}$ kPa, to recover purified fatty acids which are essentially free of cholesterol and other sterols, and phosphorus compounds.

15. The process of claim 7, wherein step (A) is carried out in the presence of an aqueous alkali in the form of a alkali metal lower alkoxide.

16. The process of claim 15, wherein the alkaline metal lower alkoxide is sodium methoxide or potassium methoxide.

17. The process of claim 1 wherein the polyhydric alcohol of step (D) is selected from the group consisting of glycerol, propylene glycol, ethylene glycol, sorbitol, sucrose, erythritol, pentaerythritol, mannitol, fructose, glucose, xylitol, and lactitol.

18. The process of claim 17 wherein the polyhydric alcohol is glycerol, thereby forming triglycerides.

19. The process of claim 7 wherein the polyhydric alcohol of step (D) is glycerol, thereby forming triglycerides.

20. The process of claim 19, wherein said triglycerides include esterified AA and DHA fatty acids having less than 1.0% of phosphorus and less than 5.0% of cholesterol based on the weight of the composition and wherein the weight-to-weight ratio of AA to sterols is greater than or equal to 1.0.

21. A triglyceride product produced by the process of claim 19.

22. A fatty acid ester product produced by the process of claim 1.

23. A process for preparing fatty acid esters containing enhanced concentrations of AA and DHA, while containing reduced quantities of phosphorus, cholesterol and other sterols from phospholipids containing AA, DHA and sterols, said process comprising the steps of:

(A) subjecting phospholipids containing AA, DHA and sterols to alkaline transesterification with a lower alkanol to produce a two phase product comprised of a lower alkyl fatty acid ester phase containing lower alkyl fatty acid esters and sterols and an aqueous phase containing water, glycerol and phosphorus compounds;

(B) separating the aqueous phase from the lower alkyl fatty acid ester phase formed in Step (A);

(C) distilling the lower alkyl fatty acid esters of Step (B) to separate and recover in the distillate lower alkyl esters of the fatty acids; and (D) subjecting the distilled lower alkyl esters to transesterification of the lower alkyl esters from Step (C) in the presence of a C1–C10 alkyl monohydric or polyhydric alcohol wherein said alcohol has a different number of carbon atoms from that used in the transesterification of Step (A) to produce fatty acid esters of said C1–C10 alcohol containing at least 1 wt % of AA, at least 0.1 wt % of DHA, less than 1.0 wt % of phosphorus and less than 5.0 wt % of sterols.

24. The fatty acid ester product of claim 23.

* * * * *